United States Patent [19]

Anderson

[11] 4,093,893

[45] June 6, 1978

[54] SHORT ARC FLUORESCENT LAMP

[75] Inventor: John M. Anderson, Scotia, N.Y.

[73] Assignee: General Electric Company, Schenectady, N.Y.

[21] Appl. No.: 743,761

[22] Filed: Nov. 22, 1976

[51] Int. Cl.[2] ..... H01J 17/34; H01J 1/15; H01J 17/20; H01J 61/16

[52] U.S. Cl. ..... 315/48; 313/185; 313/225; 313/226; 313/212; 313/217; 313/218; 313/38; 313/338; 313/339; 313/341

[58] Field of Search ..... 313/186, 185, 212, 217, 313/337, 338, 339, 341, 38; 315/48, 53, 59

[56] References Cited

U.S. PATENT DOCUMENTS

| | | | |
|---|---|---|---|
| 2,025,585 | 12/1935 | Fonda et al. | 313/185 X |
| 2,810,090 | 10/1957 | MacNair | 313/339 |
| 3,521,120 | 7/1970 | Anderson | 313/201 X |
| 3,849,699 | 11/1974 | Roche | 315/46 |
| 3,883,764 | 5/1975 | Johnson et al. | 313/212 |

*Primary Examiner*—Alfred E. Smith
*Assistant Examiner*—Charles F. Roberts
*Attorney, Agent, or Firm*—Lawrence D. Cutter; Joseph T. Cohen; Marvin Snyder

[57] ABSTRACT

A short arc fluorescent lamp comprises an envelope having dimensions compatible with existing incandescent lamp luminaires. A radio frequency power supply, enclosed within the lamp base structure, reduces anode voltage drop to increase lamp efficacy. Cathode voltage drop and sputtering are reduced by compact hollow cathode assemblies, including centrally disposed filaments, which are positioned at opposite ends of a tubular envelope assembly having a large ratio of diameter to length. Diffuse cathode emission allows operation with low pressure, low atomic weight fill gas which further increases luminous efficiency.

36 Claims, 6 Drawing Figures

Fig. 3
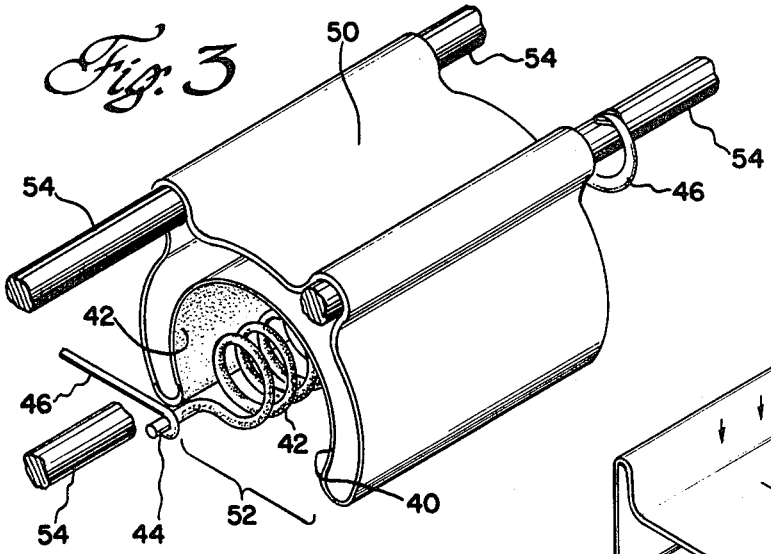
Fig. 4
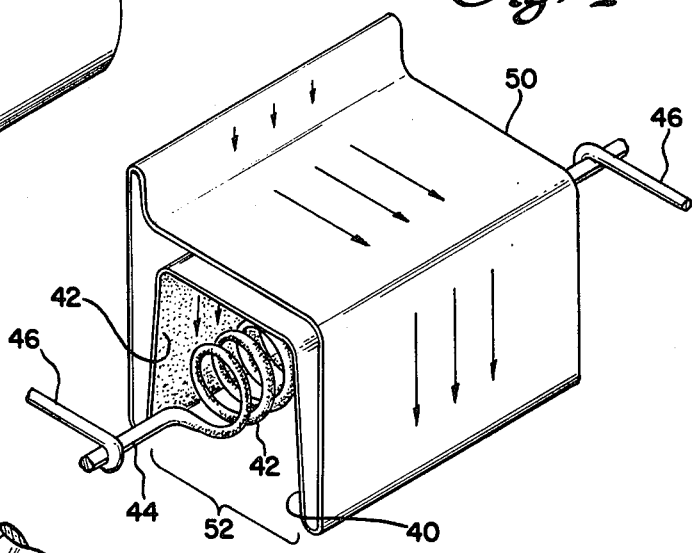
Fig. 5
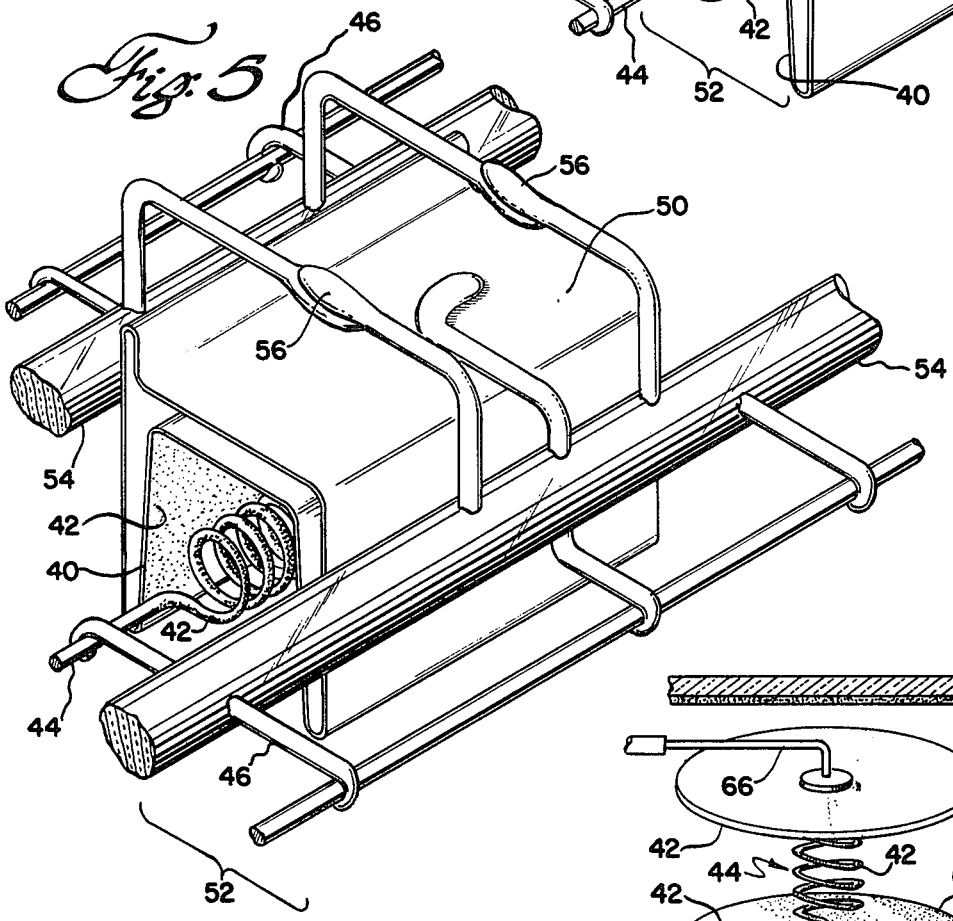
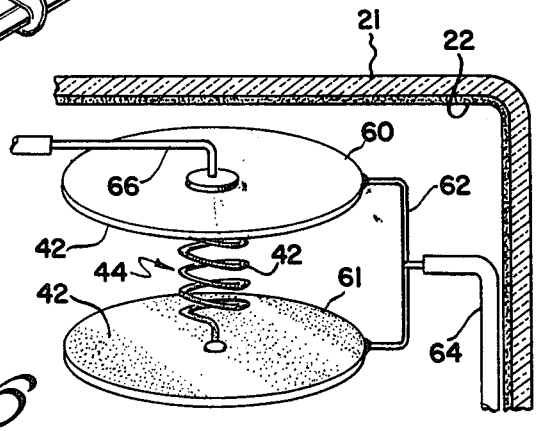
Fig. 6

SHORT ARC FLUORESCENT LAMP

This invention relates to fluorescent lamps which are adapted as replacements for existing incandescent lamps. More specifically, this invention relates to fluorescent lamps having relatively short discharge lengths wherein luminous efficiency is increased by the combined effects of low gas pressure, hollow cathode electrodes, and high frequency operation.

BACKGROUND OF THE INVENTION

The incandescent lamp is the primary luminary for household and residential lighting. This lamp generally includes an incandescent filament within a predetermined and non-oxidizing atmosphere which is contained in a teardrop shaped envelope and mounted, for example, within an Edison-type base which is screwed into a permanent fixture or into a movable socket.

Despite their wide-spread use, incandescent lamps are relatively inefficient, producing only 15 to 17 lumens per watt of input power and have relatively short, unpredictable service lives. Fluorescent lamps, which have efficacies as high as 80 lumens per watt, provide an attractive alternative to incandescent lighting. Conventional fluorescent lamps, however, require a long tubular envelope which, together with the need for auxiliary ballasting equipment, has somewhat limited their acceptance in the home lighting market. Increased residential use of fluorescent illumination, with attendent savings of energy, can be achieved from the development of fluorescent lamps which are directly compatible with existing sockets and incandescent lamp fixtures.

It has been proposed, for example in U.S. Pat. No. 3,849,699 to Roche, that a relatively short fluorescent lamp with attendent ballast components be mounted directly to a screw base for operation in incandescent lamp sockets. However, when a conventional fluorescent lamp is reduced in length, the luminous efficacy is greatly reduced. The loss of efficacy in prior art, short arc fluorescent lamps has been primarily attributed to two effects: (1) the voltage drop at the lamp electrodes, and therefore power losses in the lamp, remains constant as the arc length is reduced, leaving only a small portion of the lamp input power available for light production; and (2) as the arc length is reduced, the voltage drop across the discharge column is, likewise, reduced; the lamp current must, therefore, be greatly increased to maintain the input power. The positive column efficacy decreases as a function of increasing current. Increased lamp current causes lower positive column efficacy and shorter lamp life primarily because of excessive phosphor excitation.

It is known that in certain regimes of operation, the voltage drop of a gas discharge may be increased by decreasing the gas pressure. However, lamp operation at low pressure usually causes increased sputtering of material from the lamp electrodes which, in turn, greatly shortens lamp life.

It is also known that in relatively low pressure gases, the voltage drop at hollow cathodes is significantly lower than the voltage drop at equivalent conventional lamp electrodes. Hollow cathodes are, however, often difficult to start in a fluorescent lamp environment. My U.S. Pat. No. 3,883,764 with Peter D. Johnson, describes a hybrid cathode structure which combines a conventional coated lamp electrode with a hollow cathode structure to achieve the advantages of a hollow cathode with rapid starting characeristics.

SUMMARY OF THE INVENTION

A fluorescent lamp adapted for operation in conventional incandescent lamp fixtures comprises a short, substantially tubular glass envelope attached, at one end, to a conventional incandescent lamp base. The envelope encloses a mixture of inert gas and mercury vapor at a preferential pressure in the range from 0.5 to 1.0 torr which provides a high discharge voltage drop. Hybrid electrodes, including both coated hollow cathodes and conventional coated heaters, are disposed at opposite ends of the envelope and act to reduce end losses in the discharge and to minimize sputtering of cathode material which might, otherwise, occur in a low pressure environment. The lamp is driven from a high frequency power supply, which may be enclosed in a lamp base, at frequencies which minimize anode power losses. Radiation shields may be disposed about the electrodes to increase the temperature and, thus, further decrease voltage drop.

Lamps of the present invention provide efficacies of 50 lumens per watt and more and are compatible with conventional incandescent lamp luminaires. A relatively large diameter envelope diameter minimizes phosphor loading to provide long life and efficient operation.

It is, therefore, an object of this invention to provide efficient fluorescent lamps which are electrically and mechanically compatible with incandescent lamp luminaires and circuits.

Another object of this invention is to improve the efficacy of short arc fluorescent lamps.

Another object of this invention is to provide electrodes which allow the construction of minimal length, high efficacy fluorescent lamps.

Another object of this invention is to provide fluorescent lamp structures which allow high efficacy operation with relatively short arc lengths.

BRIEF DESCRIPTION OF THE DRAWINGS

The novel features believed characteristic of the present invention are set forth in the apended claims. The invention itself, together with further objects and advantages thereof, may best be understood by reference to the following detailed description, taken in connection with the appended drawings in which:

FIG. 3 is a hybrid electrode structure which may be included in the lamp of FIG. 1;

FIGS. 4 and 5 are alternate embodiments of the electrode structure of FIG. 3; and FIG. 6 is an alternate electrode structure for use in the lamp of FIG. 1.

DESCRIPTION OF THE PREFERRED EMBODIMENT

Figure 1:
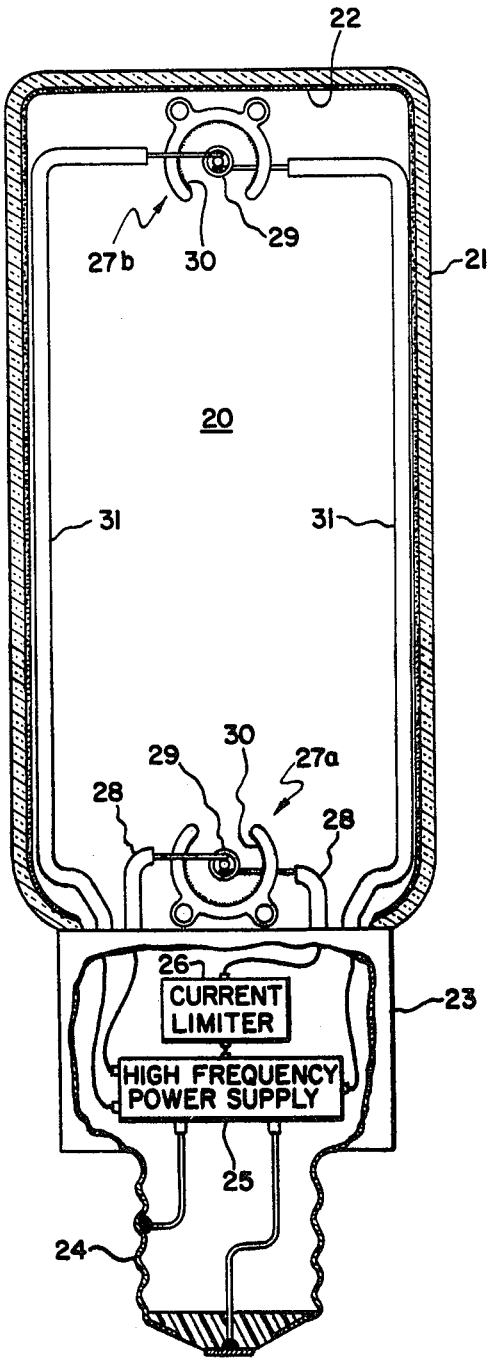
FIG. 1 is a sectional view of a short-arc fluorescent lamp of the present invention.

FIG. 1 is a fluorescent lamp of the present invention. An evacuable glass envelope 21 is coated on its inner surfaces with a phosphor 22 of the type which converts ultraviolet light into visible light and which may be any of the phosphors which are used in fluorescent lamps. The envelope 21 should be a cylinder of rotation with a substantially rectangular or oval cross section and a relatively low ratio of length of diameter and should, optimally, fit within the dimensional outlines of convention incandescent lamps. As an example, the envelope 21 may have an over-all length of approximately 15 centimeters and an inside diameter of 6.3 centimeters.

One end of the envelope 21 is attached to a base assembly 12 which includes a connector 24 for attachment to a lamp socket, as an example, the connector 24 may be an Edison-screw lamp base. The base assembly 23 encloses a high frequency power supply 25 which is connected to receive line frequency power from the connector 24 and to convert that power into high frequency power which is utilized to excite the lamp discharge. The lamp base 23 also encloses current limiting components 26 which function to swamp out the negative resistance characteristics of the electrical discharge within the lamp and, thus, provide stable operation. The current limiter 26 may comprise a ballast resistor and/or an inductor in series with the output of the high frequency power supply or it may, alternately, comprise electronic current limiting circuits which may be intimately associated with the high frequency power supply. The high frequency power supply 25 typically comprises a solid state inverter circuit. As an example, the circuit described in my U.S. Pat. No. 3,521,120 would be suitable for use in the base of those fluorescent lamps of the present invention which operate within its rated power range. The current limiter 26 and/or the high frequency power supply 25 may also include circuits for starting a discharge within the lamp envelope. Lamps of the present invention are optimally started with preheat circuits, although rapid start or other forms of starting circuits are also suitable.

A pair of electrodes 27*a* and 27*b* are disposed at opposite ends of the envelope tube 21. The electrodes (more particularly described below) are, optimally, of a generally flat configuration to allow maximum arc length within the envelope and comprise a hybrid structure including, in combination, a hollow cathode and radiation shield assembly 30 and a central coated filament 29. Connections to the electrode 27*a*, nearest the lamp base, may be made with the metal rods 28 which sealably penetrate the base end of the envelope 21. Connections to the electrode 27*b*, which is disposed furthest from the lamp base 23, are most suitably made with insulated wires 31 which are disposed along the inside surface of the envelope 21, and which sealably penetrate the base end of the envelope.

Conventional fluorescent lamps of the prior art are typically filled with inert gas for example, pure argon or mixtures of argon with neon or argon with krypton at a pressure in the range from approximately 2 torr to approximately 3 torr, and, additionally, a small amount of mercury vapor. Lamps of the present invention are optimally filled with a gas 20 which comprises mercury vapor and an inert gas at a pressure in the range from approximately 0.2 torr to 2.0 torr. Preferentially, the gas 20 is maintained at a pressure in the range from approximately 0.5 torr to approximately 1.0 torr. Reduced gas pressure utilized in the present large diameter lamp, in comparison with conventional fluorescent lamps, provides a somewhat lower voltage drop in the arc column but increases operating efficacy.

Maximum voltage gradient in the positive discharge column of practical fluorescent lamps is apparently achieved with fill gases which consist of a mixture of pure neon with mercury vapor. However, pure neon mixtures are known to produce a high cathode voltage drop, which does not contribute to increasing the luminous efficiency. I have determined that a mixture comprising from approximately 75 percent to approximately 90 percent neon and from approximately 10 percent argon to approximately 25 percent argon with mercury vapor produces a positive column gradient almost equal to that of pure neon with a markedly reduced cathode voltage drop and is, therefore, a more efficient fill gas than pure neon.

The anode voltage drop in the lamp discharge may be substantially reduced by raising the discharge frequency above normal line frequency. The luminous efficiency of lamps of the present invention has been found to increase as a function of increasing frequency for frequencies below approximately 1000 Hz. Above approximately 1000 Hz, the luminous efficiency of the lamp remains constant or increases slowly with increasing frequency. The high frequency power supply 25 is, therefore, adapted to provide an electric field between the electrodes 27*a* and 27*b* at a frequency above approximately 1000 Hz. Optimally, the electric field produced by the power supply 25 is above approximately 25 kHz to assure that any mechanical vibrations, which may be induced in the lamp structure, are above the audible range. Electromagnetic interference, as well as the cost of components in the power supply 25, increases substantially at operating frequencies above 1 MHz, which, with present component technology, represents the maximum power supply frequency which is useful in an economic lamp.

A typical lamp of the embodiment of FIG. 1 comprises electrodes 27*a* and 27*b* spaced approximately 12.5 centimeters apart in an envelope having an inside diameter of 6.3 centimeters and is, thus, characterized by a ratio of discharge length to envelope diameter of approximately 2. This lamp produces a discharge which substantially fills the envelope and permits a low level of phosphor loading which, in turn, provides increased lamp life.

Figure 2:
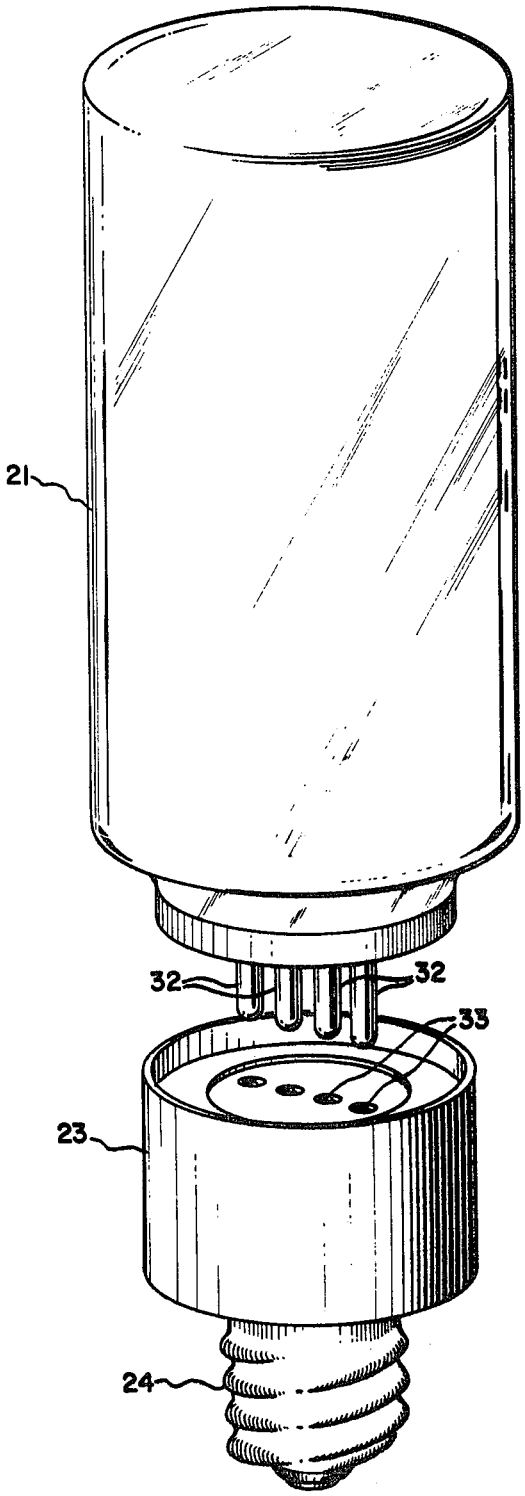
FIG. 2 is an alternate embodiment of the fluorescent lamp of FIG. 1 with a removable base structure.

FIG. 2 is an alternate embodiment of the lamp of FIG. 1 wherein the envelope 21 is detachably affixed to the base 23 with a plug 32 and socket 33 connection. Lamp embodiments of this type allow separate replacement of the base and envelope assemblies in the event of a failure in either of those components.

Prior art fluorescent lamps which operated with low gas pressure in the high discharge current region were characterized by premature failure due, in a large part, to the evaporation and sputtering of cathode emission material from a high current arc spot. An electrode structure which minimizes such sputtering, while maintaining low voltage drop and a high luminous efficiency, is, therefore, necessary for the economic operation of short-arc fluorescent lamps. The over-all length of the envelope 22 may, further, be reduced by the use of electrode assemblies which have minimum thickness.

FIG. 3 is an electrode embodiment which is useful in fluorescent lamps of the present invention. An inner metal sleeve 40 is formed in an open-ended slotted cylinder and is coated on its inside surface with an emission material 42 which may comprise barium oxide or any other emission material used in lamps for this purpose. A filament 44 is similarly coated with the emission material 42 and is axially disposed within the inner sleeve 40. Lead wires 46 are attached to opposite ends of the filament to provide a path for current which heats the filament prior to lamp starting in a conventional manner. One end of the filament 44 is electrically connected to the inner sleeve 40. A heat shield comprising an open-ended, slotted cylindrical metal structure 50 is disposed coaxially around the inner sleeve 40. The edges of the slot of the outer heat shield 50 are jointed to the edges of the slot on the inner sleeve 40 to define a cathode opening 52. The cathode assembly may, if desired, be supported and positioned within a lamp envelope on metal rods 54 which are attached to folds in the back surface of heat shield 50.

The structure of FIG. 3 operates as a hollow cathode and provides diffuse electron emission through the opening 52. The diffuse emission mode, which is characterized by the absence of a defined arc spot, significantly decreases sputtering of the emission material which would otherwise characterize a lamp operating in the high current-low pressure region. The emission material on the cathode structure of FIG. 3 is, further, confined within the substantially closed sleeve structure which tends to retain evaporated material and prevent deposition thereof on adjacent lamp envelope structures. Premature lamp failure is, thereby, controlled. The thickness of the structure, from the opening 52 to the rods 54 may, if desired, be compressed to the extent necessary to provide thin electrodes and thus minimize the over-all length of a lamp envelope.

Hollow cathode structures are, typically, difficult to start in fluorescent lamp environments. The centrally disposed filament 44 provides a concentrated emission source to permit easy starting, as is in the case of conventional fluorescent lamps. The discharge initially forms a spot on the filament 44 and shifts to a diffuse mode along the opening 52. The filament also provides a source of emission material 42 which replaces any material which may be sputtered or evaporated from the inner surface of the sleeve 40. If desired, the sleeve 40 may be initially formed without an emissive coating and the coating 42 evaporated thereon from the surface of the filament 44.

FIG. 4 is an alternate embodiment of the electrode structure of FIG. 3 formed as an open-sided rectangle which operates in substantially the same manner as the structure of FIG. 3. The rectangular structure of FIG. 4 is more rigid than the cylindrical structure of FIG. 3 and may permit simpler manufacture.

FIG. 5 is an assembly including the electrode of FIG. 4 and further including glass rods 54 which are attached to and support the heat shield 50 with metal wires 56. The filament connection leads 46 pass through the glass rods 54 and thus support the filament 44 centrally within the inner sleeve 40.

The radiation shield 50 which surrounds the hollow cathode sleeve 40 functions to raise the temperature of the cathode sleeve 40 and thus further reduces the cathode voltage drop to provide high luminous efficiency. The heat shield also provides a closed loop structure which allows RF heating for out-gassing during lamp manufacture. During such indirect heating, RF currents will flow around the outer surface of the heat shield and inner sleeve as indicated by the arrows in FIG. 4. In a typical cathode embodiment, the heat shield and inner sleeve are formed from vacuum compatible metals with high melting temperature, for example, molybdenum, tantalum, and/or nickel and are from approximately 0.02 to approximately 0.05 millimeters thick. The inner oxide coated filament 44 is a type used in fluorescent lamps and, may, for example, comprise tungsten.

FIG. 6 is an alternate cathode embodiment useful in the lamp of FIG. 1. Two metal sheets 60 and 61 are disposed parallel to each other and perpendicular to the lamp axis. The inner surfaces of the metal sheets are coated with an electron emission mix 42 of a conventional type, which may be the mix described above. An emission mix-coated filament 44 is disposed between the metal sheets 60 and 61 along the lamp axis. One end of the filament 44 is attached to the center of one of the sheets 61, while the other end of the filament penetrates and is insulated from the other sheet 60. The sheets 60 and 61 are connected together and supported with a metal rod 62. Electric current to heat the filament is provided from leads 64 and 66 which are connected, respectively, to the metal rod 62 and to the end of the filament which penetrates the sheet 60.

Short arc fluorescent lamps of the present invention are electrically and mechanically compatible with existing incandescent lamp luminaires and provide highly efficient long-lived operation. Cathode structures for the lamps of the present invention provide central starting filaments and diffuse emission sources to reduce the deteriorating effects of sputtering and provide long lamp life in a compact structure.

While the invention has been described in detail herein in accord with certain preferred embodiments thereof, many modifications and changes therein may be effected by those skilled in the art. Accordingly, it is intended by the appended claims to cover all such modifications and changes as fall within the spirit and scope of the invention.

The invention claimed is:

1. An improved short-arc fluorescent lamp of the type comprising two electrodes disposed in a gas and contained within and at opposite ends of a substantially tubular, light-transmissive evacuable envelope; wherein, as an improvement:

said gas comprises inert gases at a pressure between approximately 0.2 torr and approximately 2.0 torr; and each of said electrodes comprises a heated filament coated with an electron emissive material and disposed within a substantially hollow cathode element which is adapted to provide a diffuse termination for an electric discharge, said cathode element having at least one aperture therein for electron emission therefrom, each of said electrodes having a dimension along the axis of the envelope no greater than its dimension across the envelope, whereby the arc distance is lengthened; and said tubular envelope has a large diameter substantially half its length, whereby the envelope area is increased and phosphor loading is lessened.

2. The lamp of claim 1 wherein said gas is neon and mercury vapor.

3. The lamp of claim 1 wherein said gas comprises a mixture of from approximately 75 percent to approximately 90 percent neon;

from approximately 25 percent to approximately 10 percent argon; and mercury vapor.

4. The lamp of claim 3 wherein said gas is maintained at a pressure of approximately 1 torr during operation of said lamp.

5. The lamp of claim 1 wherein each of said electrodes comprises a coated filament centrally disposed within a slotted open-ended cathode element, said cathode element being internally coated with an electron emissive material.

6. The lamp of claim 5 wherein said electron emissive material comprises barium oxide.

7. The lamp of claim 5 wherein said cathode element has a substantially cylindrical cross section.

8. The lamp of claim 5 wherein said electrode has an open-sided, substantially rectangular cross section.

9. The lamp of claim 5 further comprising a heat shield disposed around said cathode element.

10. The lamp of claim 9 wherein said heat shield is a slotted, open-ended structure, the edges of a slot in said heat shield being aligned with and attached to the edges of a slot in said cathode element to define, thereby, an opening for diffuse electron emission.

11. The lamp of claim 1 wherein the ratio of the distance between said electrodes to the diameter of said envelope is approximately two to one.

12. The lamp of claim 1 further comprising a lamp base assembly, attached to one end of said envelope, containing means for receiving electric power from a line source and means for supplying power to an electric discharge between said electrodes.

13. The lamp of claim 12 wherein the means for receiving said electric power is a screw-type lamp plug.

14. The lamp of claim 12 wherein said means for supplying power to said electric discharge functions to produce an electric field, at a frequency of approximately 1 kHz or more, between said electrodes.

15. The lamp of claim 14 wherein said frequency is greater than approximately 25 kHz.

16. The lamp of claim 12 further including means for limiting current flow in said discharge.

17. The lamp of claim 16 wherein said means for limiting current is contained in said base assembly.

18. The lamp of claim 12 wherein said means for supplying power is a solid state inverter.

19. The lamp of claim 18 wherein said solid state inverter includes means for limiting current in said discharge.

20. The lamp of claim 12 further including means for starting an electric discharge between said electrodes.

21. The lamp of claim 20 wherein said means for starting said discharge is contained in said base assembly.

22. The lamp of claim 20 wherein said means for starting said discharge comprises a preheat circuit.

23. A lamp comprising, in combination:

a substantially tubular, light-transmissive, evacuable envelope;

an inert gas at a pressure between approximately 0.2 torr and approximately 2.0 torr disposed within said envelope;

mercury vapor disposed within said envelope;

electrodes, disposed in opposite ends of said tubular envelope, each electrode comprising a heated filament coated electron emissive material disposed within substantially hollow electron emitting means, which means function to provide a diffuse termination for an electric discharge;

means for producing an alternating electric field, at a frequency above approximately 1 kHz, between said electrodes; and means for limiting current flow between said electrodes.

24. The lamp of claim 23 further comprising a base assembly attached to one end of said tubular envelope and including means for receiving power from a lamp socket connector.

25. The lamp of claim 24, wherein said means for producing said field are enclosed in said base assembly.

26. The lamp of claim 23 wherein each of said electrodes comprises:

a slotted, open-ended cathode element disposed around said filament; and a slotted open-ended heat shield disposed around said cathode element;

the edges of a slot in said cathode element and the edges of a slot in said heat shield being aligned and joined together to define an opening for diffuse electron emission.

27. The lamp of claim 26 wherein the slots of said electrodes are disposed towards the center of said tubular envelope.

28. The lamp of claim 26 further including a layer of phosphor disposed on the surface of said envelope.

29. The lamp of claim 28 wherein the ratio of the distance between said electrodes to the diameter of said envelope is approximately two to one.

30. The lamp of claim 23 further including means for starting a discharge between said electrodes.

31. A lamp electrode comprising, in combination:

a heated filament;

an electron emissive material disposed on said filament;

an open-ended, slotted cathode element disposed around said filament;

an open-ended, slotted heat shield disposed around said cathode element, the edges of a slot in said cathode element being aligned with and attached to the edges of a slot in said heat shield to define therebetween an opening for diffuse electron emission.

32. The electrode of claim 31 further comprising an electron emissive material disposed on inner surfaces of said cathode element.

33. The lamp of claim 31 wherein said cathode element and said heat shield have substantially cylindrical cross sections.

34. The electrode of claim 31 wherein said cathode element and said heat shield have substantially open-sided rectangular cross sections.

35. The electrode of claim 31 further comprising means, attached to said heat shield, for supporting and positioning said electrode within a lamp envelope.

36. The electrode of claim 31 further comprising means for supporting said filament within said cathode element.

* * * * *